US010829876B2

(12) United States Patent
Padin

(10) Patent No.: US 10,829,876 B2
(45) **Date of Patent: *Nov. 10, 2020**

(54) SHAPEWEAR GARMENT WITH MESH REGIONS

(71) Applicant: HBI Branded Apparel Enterprises, LLC, Winston Salem, NC (US)

(72) Inventor: Carmelo Padin, Clarksville, AR (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 55 days.

This patent is subject to a terminal disclaimer.

(21) Appl. No.: 16/374,473

(22) Filed: Apr. 3, 2019

(65) Prior Publication Data

US 2019/0223520 A1 Jul. 25, 2019

Related U.S. Application Data

(63) Continuation of application No. 15/816,102, filed on Nov. 17, 2017, now Pat. No. 10,294,593.

(Continued)

(51) Int. Cl.
*D04B 1/24* (2006.01)
*A41C 1/00* (2006.01)

(Continued)

(52) U.S. Cl.
CPC ..... *D04B 1/243* (2013.01); *A41B 9/001* (2013.01); *A41B 9/04* (2013.01); *A41C 1/003* (2013.01);

(Continued)

(58) Field of Classification Search
CPC ... D04B 1/06; D04B 1/18; D04B 1/24; D04B 1/243; D04B 1/104; A41B 9/04;

(Continued)

(56) References Cited

U.S. PATENT DOCUMENTS

| | | | |
|---|---|---|---|
| 737,975 | A | 9/1903 | Trimble |
| 2,285,012 | A | 6/1942 | Burkey |

(Continued)

FOREIGN PATENT DOCUMENTS

| | | |
|---|---|---|
| DE | 102011000398 | 4/2012 |
| EP | 1367161 | 12/2003 |
| FR | 2899068 | 10/2007 |

OTHER PUBLICATIONS

International Preliminary Report on Patentability in International Application No. PCT/US2018/022971, dated Oct. 3, 2019, 8 pages.

(Continued)

*Primary Examiner* — Danny Worrell
(74) *Attorney, Agent, or Firm* — Fish & Richardson P.C.

(57) ABSTRACT

The subject matter of this specification can be embodied in, among other things, an undergarment that includes a pant body having an anterior knit region having a first knitting pattern, a posterior knit region having the first knitting pattern, a first lateral knit region having a second knitting pattern different from the first knitting pattern, extending between the anterior knit region and the posterior knit region, and a second lateral knit region having the second knitting pattern, extending between the anterior knit region and the posterior knit region, and a gusset panel having the second knitting pattern, extending between an entirety of the anterior knit region and the posterior knit region.

17 Claims, 6 Drawing Sheets

Related U.S. Application Data

(60) Provisional application No. 62/473,906, filed on Mar. 20, 2017.

(51) Int. Cl.

| | |
|---|---|
| ***A41B 9/00*** | (2006.01) |
| ***D04B 1/06*** | (2006.01) |
| ***A41B 9/04*** | (2006.01) |
| ***A41D 1/08*** | (2018.01) |
| ***D04B 1/18*** | (2006.01) |
| ***D04B 1/10*** | (2006.01) |

(52) U.S. Cl.
CPC ..... *A41D 1/08* (2013.01); *D04B 1/06* (2013.01); *D04B 1/104* (2013.01); *D04B 1/18* (2013.01); *A41B 2400/38* (2013.01); *A41D 2400/38* (2013.01); *D10B 2501/021* (2013.01)

(58) Field of Classification Search
CPC ..... A41B 9/001; A41B 2400/38; A41C 1/003; A41D 2400/38
See application file for complete search history.

(56) References Cited

U.S. PATENT DOCUMENTS

| | | | |
|---|---|---|---|
| 3,526,229 | A | 9/1970 | Blair |
| 3,625,029 | A | 12/1971 | Safrit et al. |
| 3,946,579 | A | 3/1976 | Heinig |
| 5,590,548 | A | 1/1997 | Osborne |
| 5,689,836 | A | 11/1997 | Fee |
| 5,888,118 | A | 3/1999 | Kishi |
| 6,041,441 | A | 3/2000 | Counts |
| 6,401,250 | B1 | 6/2002 | McNabb |
| 6,651,463 | B2 | 11/2003 | Bonnin |
| 7,024,892 | B2 | 4/2006 | Blakely |
| 7,260,961 | B1 | 8/2007 | Kennedy |
| 7,441,418 | B2 | 10/2008 | Delgado-Mecinas |
| 7,509,822 | B2 | 3/2009 | Ishida |
| 7,526,929 | B2 | 5/2009 | Takamoto et al. |
| 8,381,314 | B2 | 2/2013 | Takamoto |
| 9,655,388 | B2 | 5/2017 | Michel |
| 10,053,804 | B2 | 8/2018 | Frantz |
| 10,294,593 | B2 | 5/2019 | Padin |
| 10,400,369 | B2 | 9/2019 | Altmann et al. |
| 2001/0035032 | A1 | 11/2001 | Blakely |
| 2004/0016043 | A1 | 1/2004 | Uno et al. |
| 2004/0045325 | A1 | 3/2004 | Rabinowicz |
| 2014/0000004 | A1 | 1/2014 | Baron et al. |
| 2018/0249777 | A1 | 9/2018 | Turner |
| 2019/0223520 | A1 | 7/2019 | Padin |

OTHER PUBLICATIONS

International Search Report and Written Opinion in International Application No. PCT/US2018/022971, dated Jun. 6, 2018, 11 pages.

International Search Report and Written Opinion in International Application No. PCT/US2018/050899, dated Dec. 5, 2018, 17 pages.

International Preliminary Report on Patentability in International Application No. PCT/US2018/050899, dated Mar. 26, 2020, 10 pages.

SHAPEWEAR GARMENT WITH MESH REGIONS

CROSS REFERENCE TO RELATED APPLICATION(S)

This application is a continuation of and claims the benefit of priority to U.S. patent application Ser. No. 15/816,102, filed Nov. 17, 2017, which claims the benefit of priority to U.S. Provisional Patent Application Ser. No. 62/473,906, filed Mar. 20, 2017, the contents of which are hereby incorporated by reference.

TECHNICAL FIELD

This disclosure relates to undergarments, for example, women's shapewear undergarments or underwear.

BACKGROUND

Shapewear undergarments exist in a number of forms, such as bodysuits, waist cinchers, and shaping panties. Each style provides a different combination of fit, comfort, support, and shaping. During normal movement or athletic activity, discomfort can result from body heat and/or perspiration that can build up between the wearer's skin and the garment.

SUMMARY

In general, this document describes undergarments, for example, women's shapewear undergarments or underwear.

In a first aspect, an undergarment includes a pant body having a first end and a second end opposite the first end and having an anterior knit region having a first knitting pattern, a first outer edge and second outer edge, and a first inner edge and second inner edge, and configured to stretch across a portion of a wearer's pelvic area, a posterior knit region having the first knitting pattern, a third outer edge and a fourth outer edge, and a third inner edge and a fourth inner edge, and configured to stretch about a portion of the wearer's gluteal area, a first lateral knit region having a second knitting pattern different from the first knitting pattern, extending between the first outer edge of the anterior knit region and the third outer edge of the posterior knit region, and configured to stretch about a portion of the wearer's left hip and a lateral portion of the wearer's left upper thigh, and a second lateral knit region having the second knitting pattern, extending between the outer edge of the anterior knit region and the outer edge of the posterior knit region, and configured to stretch about a portion of the wearer's right hip and a lateral portion of the wearer's right upper thigh, and a gusset panel having the second knitting pattern, extending between an entirety of the inner edge of the anterior knit region and the inner edge of the posterior knit region, and configured to stretch about an inner portion of the wearer's left upper thigh, a portion of the wearer's groin, and an inner portion of the wearer's right upper thigh.

Various embodiments can include some, all, or none of the following features. The anterior knit region, the first lateral knit region, the posterior knit region, and the second lateral knit region can be a circularly knit tubular body. The gusset panel can be stitched to the anterior knit region and to the posterior knit region. The second knitting pattern can be a knit mesh pattern. The regions having the second knitting pattern can weigh less than 8.5 ounces per square yard. The regions having the second knitting pattern can be elastic 2×2 float knit structures having a ground yarn covered with an elastomer, float plated with a nylon thread. The second knitting pattern can include a collection of groups of three first openings arranged in a line, the groups can be spaced apart by a plurality of second openings that are smaller than the first openings, and the regions having the second knitting pattern can have about 300 of the groups per square inch when the knit mesh is relaxed. The undergarment can include a tubular waistband attached to the anterior knit region, the first lateral knit region, the posterior knit region, and the second lateral knit region at the first end of the pant body. The undergarment can include at least one of a first tubular leg band attached to the anterior knit region, the first lateral knit region, the posterior knit region, and the gusset panel at the second end of the pant body opposite the first end, and a second tubular leg band attached to the anterior knit region, the second lateral knit region, the posterior knit region, and the gusset panel at the second end of the pant body opposite the first end. The undergarment can include a run guard knit region having a positive float pattern with an alternating 1×1 knit structure connecting at least one of the inner edge of the anterior knit region and the inner edge of the posterior knit region to a lengthwise centrally located edge portion of the gusset panel.

In a second aspect, a method of making an undergarment can include circularly knitting a tubular blank to form a body of an undergarment, the body having a first end and a second end opposite the first end and having an anterior knit region having a first knitting pattern, having an outer edge and an inner edge, and configured to stretch across a portion of a wearer's pelvic area, a posterior knit region having the first knitting pattern, having an outer edge and an inner edge, and configured to stretch about a portion of the wearer's gluteal area, a first lateral knit region having a second knitting pattern different from the first knitting pattern, extending between the outer edge of the anterior knit region and the outer edge of the posterior knit region, and configured to stretch about a portion of the wearer's left hip and a lateral portion of the wearer's left upper thigh, and a second lateral knit region having the second knitting pattern, extending between the outer edge of the anterior knit region and the outer edge of the posterior knit region, and configured to stretch about a portion of the wearer's right hip and a lateral portion of the wearer's right upper thigh, cutting a first lateral seam through a centrally located portion of the second end of the anterior knit region, cutting a second lateral seam through a centrally located portion of second end of the posterior region, and stitching a gusset panel, having the second knitting pattern, between an entirety of the first seam and the second seam, and configured to stretch about an inner portion of the wearer's left upper thigh, a portion of the wearer's groin, and an inner portion of the wearer's right upper thigh.

Various implementations of the method can include some, all, or none of the following features. The method can also include knitting the second knitting pattern in a knit mesh pattern. The regions having the second knitting pattern can have a weight of less than 8.5 ounces per square yard. The regions having the second knitting pattern can be elastic 2×2 float knit structures comprising a ground yarn covered with an elastomer that is float plated with a nylon thread. The second knitting pattern can include a collection of groups of three first openings arranged in a line, wherein the groups are spaced apart by a plurality of second openings that are smaller than the first openings, and the regions having the second knitting pattern comprise about three-hundred of the groups per square inch when the knit mesh is relaxed. The method can also include circularly knitting a tubular blank to form a tubular waistband of the undergarment, and stitching the tubular waistband to the anterior knit region, the first lateral knit region, the posterior knit region, and the second lateral knit region at the first end of the pant body. The method can also include knitting a first leg band knit region having the first knitting pattern along a portion of the first lateral panel proximal the second end, and knitting a second leg band knit region having the first knitting pattern along a portion of the second lateral panel proximal the second end. The method can include knitting a first gusset leg band knit region having the first knitting pattern along a portion of a first longitudinal end of the gusset panel, knitting a second gusset leg band knit region having the first knitting pattern along a portion of a second longitudinal end of the gusset panel opposite the first longitudinal end of the gusset panel, stitching the first gusset leg band knit region to the anterior knit region and to the posterior knit region proximal the second end, and stitching the second gusset leg band knit region to the anterior knit region and to the posterior knit region proximal the second end. The method can also include circularly knitting a run guard knit region having a positive float pattern with an alternating 1×1 knit structure into a medial region of the anterior knit region and a medial region of the posterior knit region, and stitching the a lengthwise centrally located edge portion of the gusset panel to the run guard knit region, wherein at least one of the first lateral seam and the second lateral seam extend from the centrally located portion of the second end to the run guard knit region.

The systems and techniques described here may provide one or more of the following advantages. First, a system can provide a garment with additional flexibility and breathability in target areas of the garment to increase comfort for a wearer of the garment.

The details of one or more implementations are set forth in the accompanying drawings and the description below. Other features and advantages will be apparent from the description and drawings, and from the claims.

DETAILED DESCRIPTION

This disclosure describes shapewear garments, for example, undergarments to shape, support, and contour the upper thigh, pelvic, and gluteal regions (e.g., thigh slimmer, lower torso garment). In general, the garments include a knit mesh in certain portions of the shapewear garment, and the knit mesh has elastic and ventilation properties that differ from those of other regions of the garment.

FIGS. 1-5 are front (e.g., anterior), rear (e.g., posterior), left, right, and bottom views of an example undergarment 100. The undergarment 100 includes a pant body 110, a waistband 150, a leg band 180*a*, and a leg band 180*b*.

Figure 1:
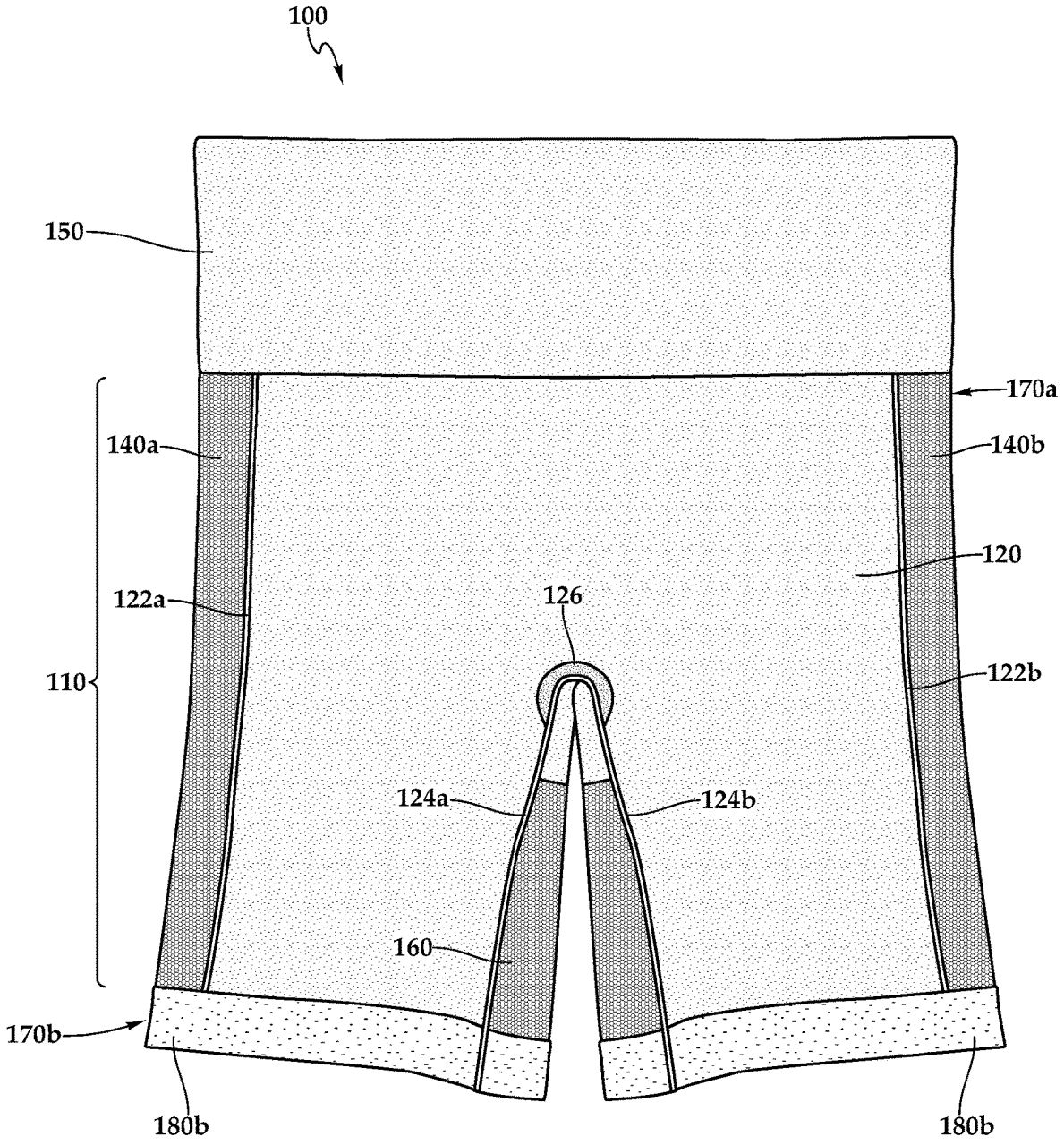
FIG. 1 is a front view of an example undergarment.

Referring mainly to FIG. 1, the pant body 110 of the example undergarment 100 is a circularly knit garment that includes an anterior knit region 120 having an outer edge 122*a* and an outer edge 122*b*, and an inner edge 124*a* and an inner edge 124*b*. In some instances, circularly knitting the garment produces a seamless garment, for example, where different regions of the garment can be seamlessly joined to each other. When the undergarment 100 is worn, the anterior knit region 120 overlays, covers, or extends over a portion of a wearer's pelvic area. In some instances, when the undergarment is worn by a wearer, the anterior knit region 120 stretches to some degree over the wearer's pelvic area. The undergarment 100 also includes a gusset panel 160 that is stitched to the inner edge 124*a* and the inner edge 124*b*. The gusset panel 160 will be discussed further with regard to the descriptions of FIGS. 2-5. The anterior knit region 120 also includes a run guard region 126 that is knit into a medial location of the anterior knit region 120.

Figure 2:
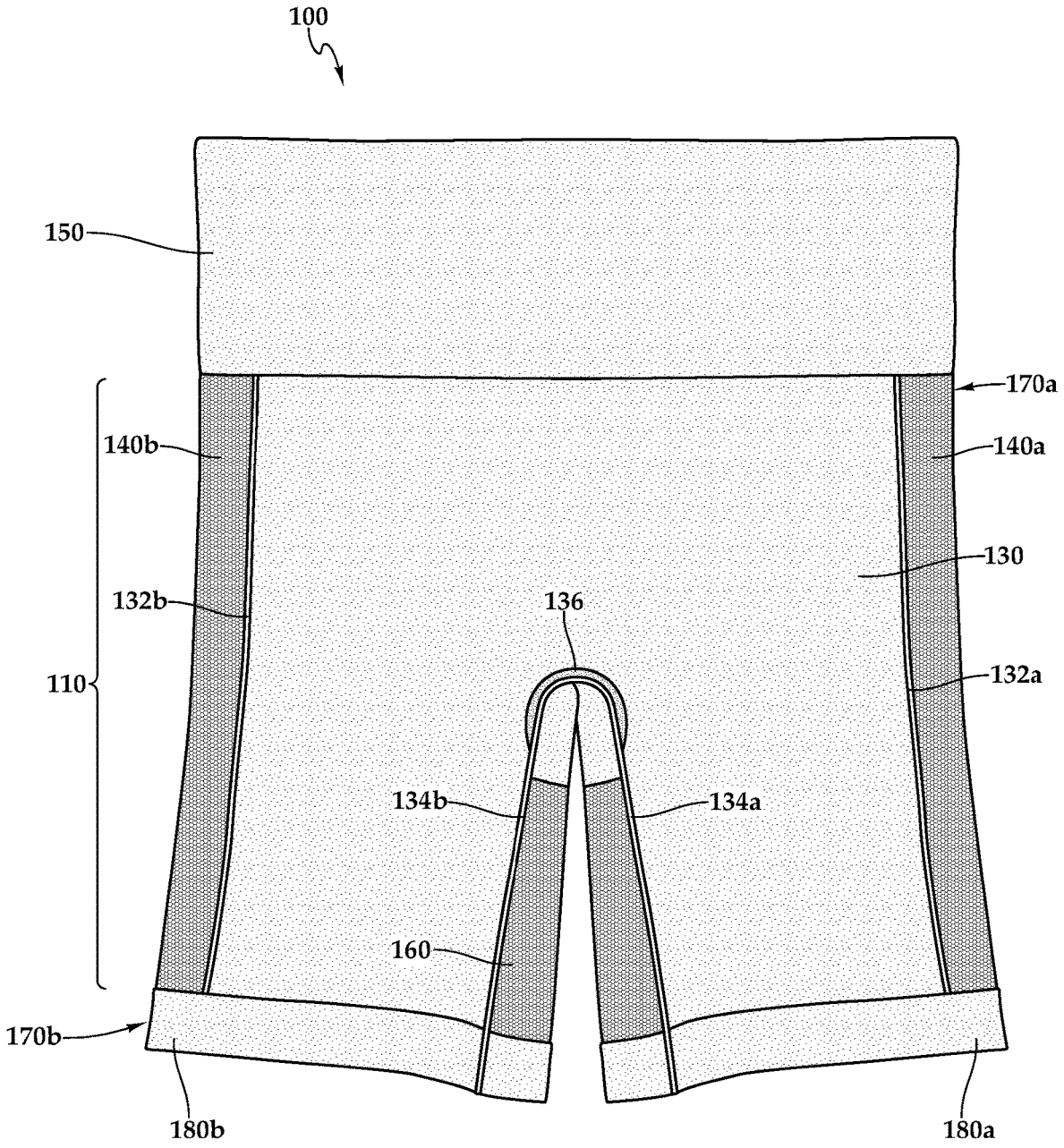
FIG. 2 is a rear view of an example undergarment.

Referring mainly to FIG. 2, the pant body 110 of the example undergarment 100 also includes a posterior knit region 130 having an outer edge 132*a* and an outer edge 132*b*, and an inner edge 134*a* and an inner edge 134*b*. The posterior knit region 130 also includes a run guard region 136 that is knit into a medial location of the posterior knit region 130. The gusset panel 160 is also stitched to the inner edge 134*a* and the inner edge 134*b*, including the run guard regions 126 and 136. When the undergarment 100 is worn, the posterior knit region 130 covers, or overlays, a portion of a wearer's gluteal area (e.g., the buttocks), and the gusset panel 160 covers, or overlays, portions of the wearer's upper, inner thighs and groin (e.g., the gusset panel 160 covers the crotch). When worn, some, none, or all of the regions stretch to at least generally conform to the shape of the wearer.

Figure 3:
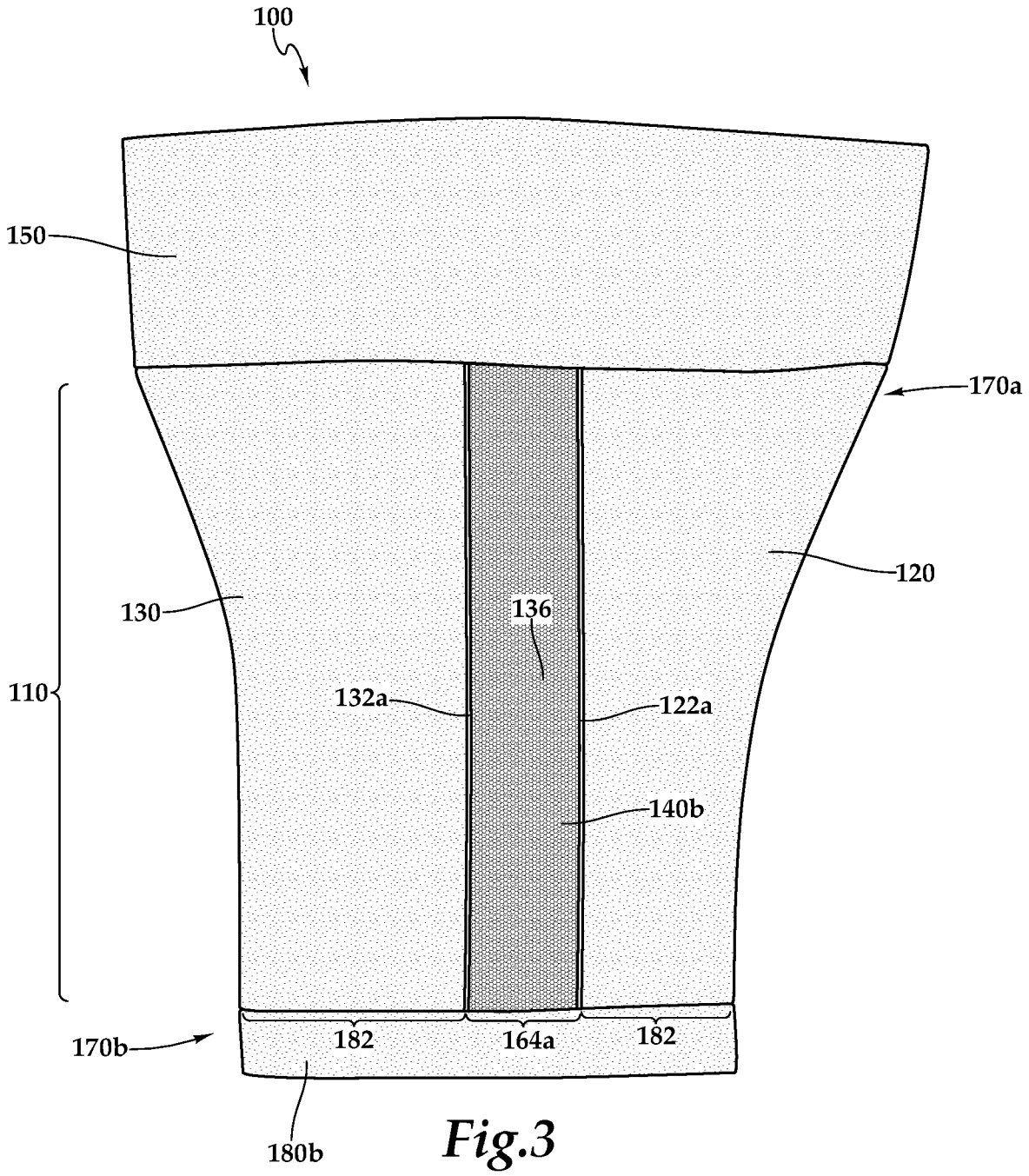
FIG. 3 is a left side view of the example undergarment.

Referring mainly now to FIG. 3, the pant body 110 of the example undergarment 100 also includes a lateral knit region 140*b* that extends between the outer edge 122*a* and the outer edge 132*a*. The lateral knit region 140*b* is arranged to cover (e.g., overlay, extend over, or stretch across) a portion of the wearer's left hip and a lateral portion of the wearer's left upper thigh when the undergarment 100 worn. In some embodiments, in a relaxed (e.g., unstretched) state, the lateral knit region 140*b* is about 1.6 inches wide and is about 9.5 inches long, although in some other embodiments the regions that are knit with the second knit pattern can have any appropriate size and/or may be used for up to the entirety of the undergarment 100. For example, the lateral knit region 140*b* can be substantially rectangular (as shown in FIG. 3), can increase and/or decrease in width along the longitudinal length of the lateral knit region 140*b*, or can be another shape generally along a lateral side of the leg of the wearer.

Figure 4:
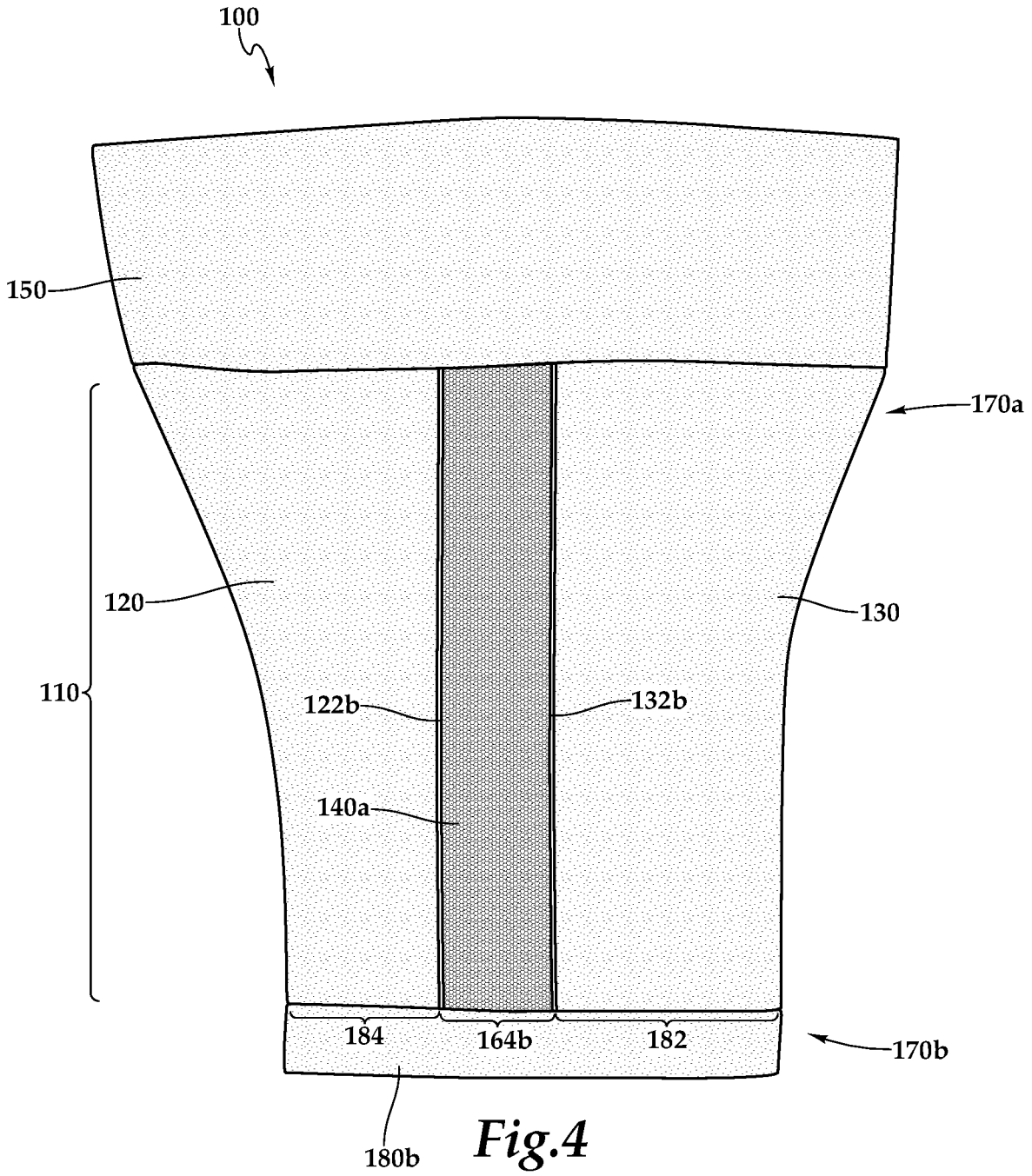
FIG. 4 is a right side view of the example undergarment.

Referring mainly now to FIG. 4, the pant body 110 of the example undergarment 100 also includes a lateral knit region 140*a* that extends between the outer edge 122*b* and the outer edge 132*b*. The lateral knit region 140*a* is arranged to cover (e.g., overlay, or stretch across) a portion of the wearer's right hip and a lateral portion of the wearer's right upper thigh when the undergarment 100 worn. In some embodiments, in a relaxed (e.g., unstretched) state the lateral knit region 140*a* is about 1.6 inches wide and is about 9.5 inches long. However, the lateral knit region 140*a* can be similarly shaped as the lateral knit region 140*b* described earlier with respect to FIG. 3. For example, lateral knit region 140*a* can mirror the size, shape, and/or location of the lateral knit region 140*b* across a plane separating a right side of the garment 100 from a left side of the garment 100. In other instances, the lateral knit regions 140*a* and 140*b* can be sized, shaped, and/or located differently from each other.

Although FIG. 3 is indicated as the left side of the garment and FIG. 4 is indicated as the right side of the garment, the garment sides and corresponding description can be opposite.

The pant body 110 is a generally tubular fabric structure. For example, the anterior knit region 120, the lateral knit region 140*a*, the posterior knit region 130, and the lateral knit region 140*b* can be circularly knit as a unitary, tubular body initially formed without seams (e.g., seamless). The leg bands 180*a* and 180*b* both include a leg band knit region 182 and a leg band knit region 184 proximal the leg ends 170*a*, 170*b*. The leg band knit regions 182 and 184 are circularly knit along with the anterior knit region 120, the posterior knit region 130, the lateral knit region 140*a*, and the lateral knit region 140*b*. The leg bands 180*a* and 180*b* of the leg band knit regions 182 and 184 can be seamlessly joined to the respective anterior knit region 120, posterior knit region 130, and/or lateral knit regions 140*a* and 140*b*. Although FIGS. 1-4 show stitched seams between some regions of the garment, the regions of the garment can be seamlessly joined, for example, by circular knitting.

The inner edges 124*a* and 124*b* are formed by making a cut in the anterior knit region 120, starting at a leg end 170*b* of the tubular structure, and extending to the run guard region 126. The inner edges 134*a* and 134*b* are formed by making a cut in the posterior knit region 130, starting the leg end 170*b* of the tubular structure, and extending to the run guard region 136.

Figure 5:
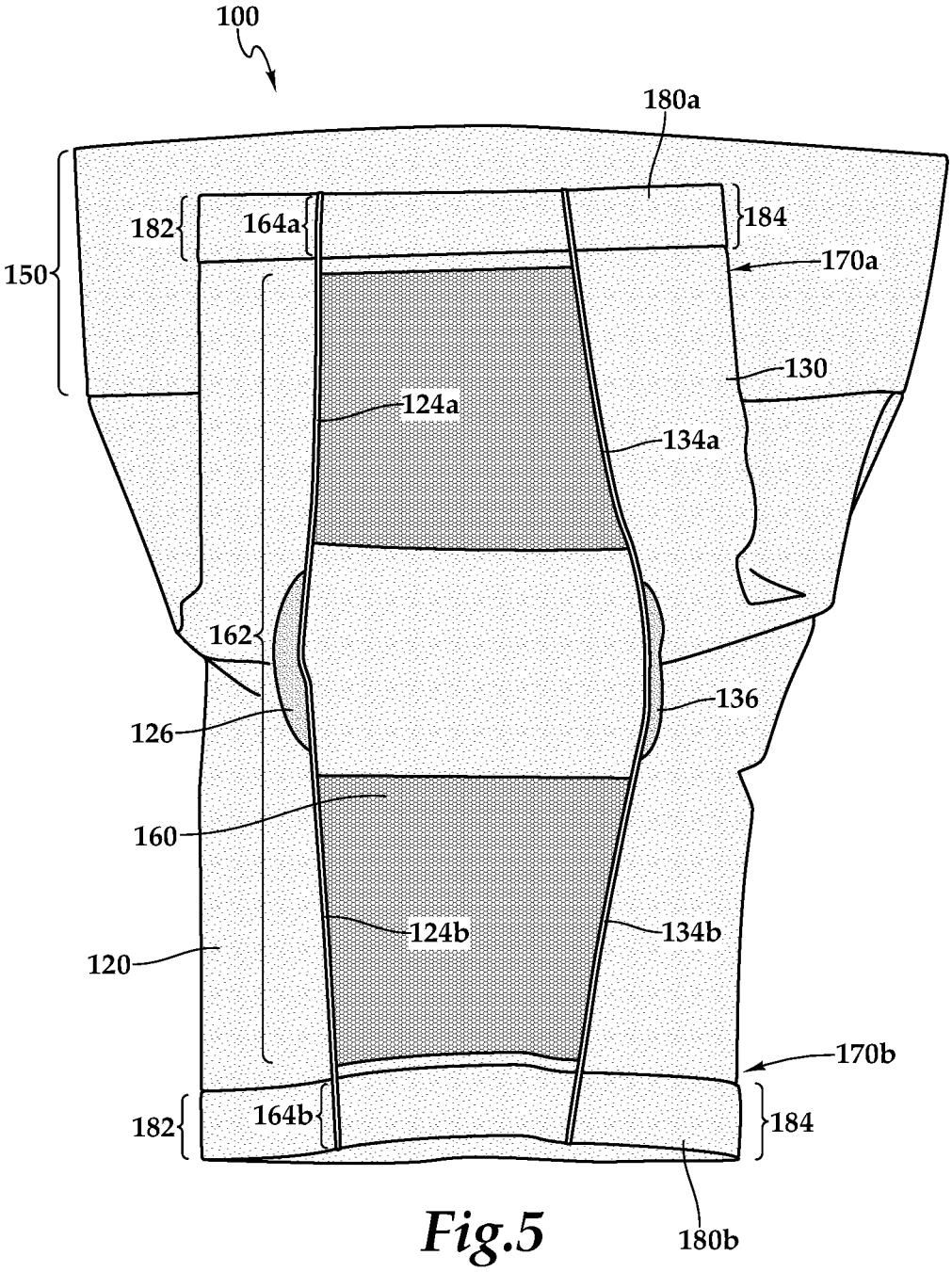
FIG. 5 is a bottom view of the example undergarment.

Referring mainly now to FIG. 5, the gusset panel 160 of the example undergarment 100 is shown in more detail. The gusset panel 160 is a longitudinal panel having a generally rectangular shape, for example, that extends from an inner left thigh of a wearer through a crotch area of the wearer to an inner right thigh of the wearer when worn by the wearer. The longitudinal panel of the gusset panel 160 includes a central knit region 162, a leg band knit region 164*a*, and a leg band knit region 164*b*. The gusset panel 160 is stitched to the pant body 110 along the inner seams 124*a*, 124*b*, 134*a*, and 134*b*. When assembled, the leg band knit regions 164*a* and 164*b* are stitched to and substantially align with the leg band regions 182 and 184 to form the leg bands 180*a* and 180*b*. When the undergarment 100 is worn, the gusset panel 160 covers, or overlays, portions of the wearer's upper inner thighs and the groin (e.g., the gusset panel 160 covers the crotch), and the leg bands 180*a* and 180*b* extend around the wearer's thighs.

The anterior knit region 120, the posterior knit region 130, the waistband 150, the leg band knit regions 182 and 184, and the run guard regions 126 and 136 of the example undergarment 100 are circularly knit as a unitary tubular body. In some implementations, one or more of the regions are knit separately from the remainder and stitched to neighboring regions. The anterior knit region 120, the posterior knit region 130, the waistband 150, and the leg band knit regions 164*a*, 164*b*, 182, and 184 are knit with a first knitting pattern, and the lateral knit region 140*a*, the lateral knit region 140*b*, and the gusset panel 160 (e.g., apart from the leg band regions 164*a* and 164*b* are knit with a second knitting pattern that is different from the first knitting pattern. In some embodiments, the first knitting pattern can be a plain knit pattern, for example, a single or double jersey knit structure. The second knitting pattern will be discussed further with respect to the description of FIGS. 6A-6B. In some embodiments, the run guard regions 126 and 136 can be knit with a third knit pattern that is different from the first and second knit patterns. For example, the run guard regions 126 and 136 can be circularly knit with a positive float pattern having an alternating 1×1 knit structure.

Figure 6A:
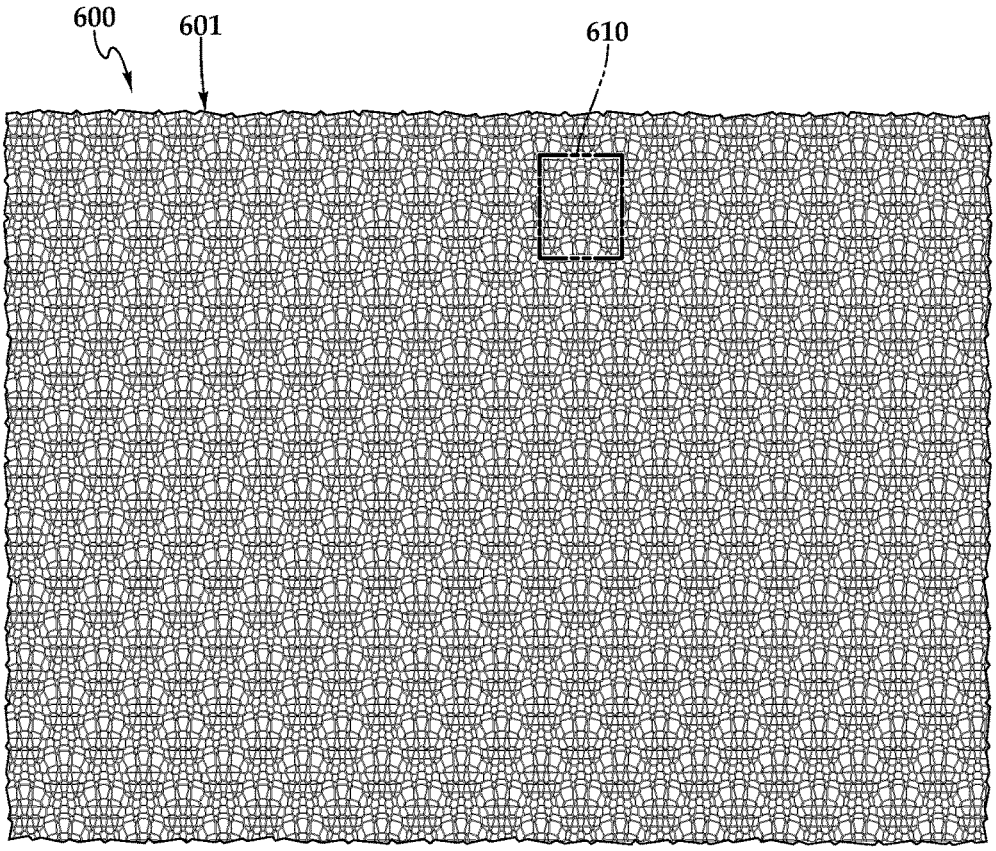
FIGS. 6A and 6B are enlarged views of an example knit region having an example stitch pattern.
Figure 6B:
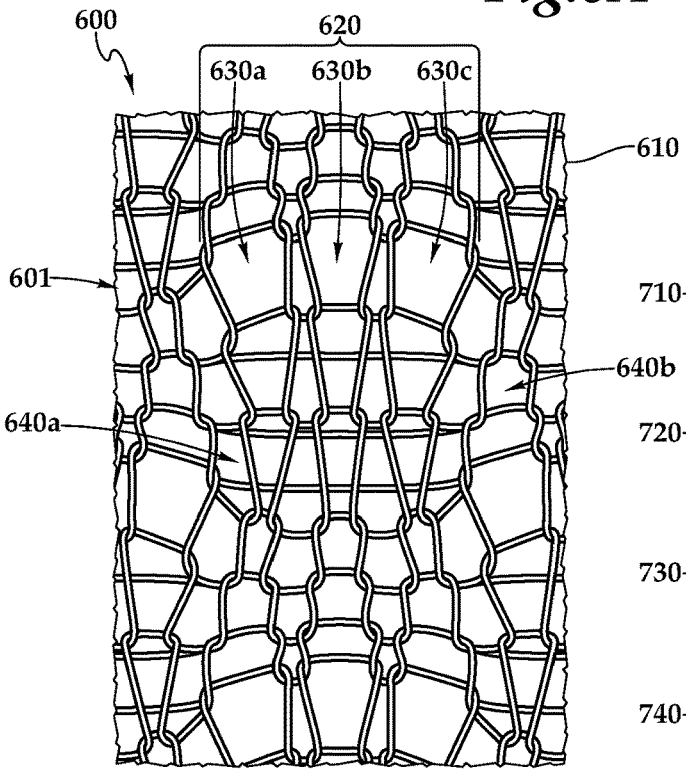

FIG. 6A is an enlarged view of a knit region 600 having an example stitch pattern 601. FIG. 6B is a further enlarged view of a section 610 of the knit region 600. In some embodiments, the stitch pattern 601 can be the second knitting pattern (e.g., used for the example lateral knit regions 140*a* and 140*b* of the pant body 110 and/or the central knit region 162 of the example gusset panel 160).

In some implementations, the example stitch pattern 601 is a knit mesh pattern of threads that, when knit together, can provide a textile having a weight of less than about 8.5 ounces per square yard (e.g., approximately 0.1859 g/sq. inch). For example, the knit mesh of the example stitch pattern 601 can provide a fabric having a weight of between 6.5 ounces per square yard and 8.5 ounces per square yard. In some implementations, the stitch pattern 601 can be used to create a fabric that exhibits about 1.5× to about 2× more stretchability and/or at least about 30% more breathability (e.g., air flow) than plain jersey fabric. In some instances where the second knitting pattern includes the example stitch pattern 601, these stretch properties and breathability properties can add comfort, support, and breathability to the wearer of the garment 100. For example, the knit mesh of the stitch pattern 601 can stretch up to 80% greater than its original, unstretched length.

Referring mainly to FIG. 6B, the example stitch pattern 601 can include a repeating pattern of float knit structures, such as elastic 2×2 float knit patterns, 3×3 float knit patters, or other float knit patterns. The stitch pattern 601 is knit using a combination of a ground yarn covered with an elastomer (e.g., spandex and/or other elastomer) that is float plated with a thread (e.g., nylon thread). The stitch pattern 601 includes a collection of groups such as a group 620. The group 620 includes three openings, such as an opening 630*a*, 630*b*, and 630*c*, arranged in a line. The groups are spaced apart by a collection of other openings, such as the openings 640*a*, 640*b*, and 640*c*, that are smaller than the openings 630*a*-630*c*. The regions having the stitch pattern 601 include about three hundred of the three-opening groups (e.g., about nine hundred of the larger openings such as 630*a*-630*c*), such as the group 620, per square inch when the region (e.g., the knit mesh of the lateral knit regions 140*a*-140*b* and/or the gusset panel 160) is relaxed.

FIGS. 6A and 6B show the example knit region 600 and the example stitch pattern 601 in a substantially stretched state. For example, the openings 630*a*-630*c* and 640*a*-640*c* appear in a near-maximum stretch of the fabric; however, in a generally relaxed state, these openings 630*a*-630*c* and 640*a*-640*c* are not visible to the naked eye. The stitch pattern 601 of the knit region 600, including floats, create the openings 630*a*-630*c* and 640*a*-640*c* as a naturally occurring pattern when knit as described above (e.g., the fabric is not perforated after knitting to create openings).

Referring back to FIGS. 3, 4, and 5, the lateral knit regions 140*a* and 140*b* and the gusset panel 160 of the example undergarment 100 include the second knit pattern, for example, a knit mesh pattern described earlier. FIGS. 3 and 4 show the lateral knit regions 140*b* and 140*a*, respectively, as including the knit mesh pattern in the entirety of the lateral knit regions 140*a* and 140*b*. However, the extent of the knit mesh pattern of the lateral knit regions 140*a* and 140*b* can be different. For example, the lateral knit regions 140*a* and 140*b* can include the knit mesh pattern in only parts of the lateral knit regions 140*a* and 140*b*, and further include a different knit structure (e.g., plain, jersey knit, alternate float pattern, or other knit pattern) in other portions of the lateral knit regions 140*a* and 140*b*. FIG. 5 also shows the example gusset panel 160 as including two regions of knit mesh positioned at lateral interior sides of the legs of the garment 100 separated by a different knit pattern at a central crotch portion of the gusset panel 160. However, the knit pattern of the gusset panel 160 can vary. For example, the gusset panel 160 can include the knit mesh throughout substantially most or all of the gusset panel 160, including the central crotch portion of the gusset panel 160.

Figure 7:
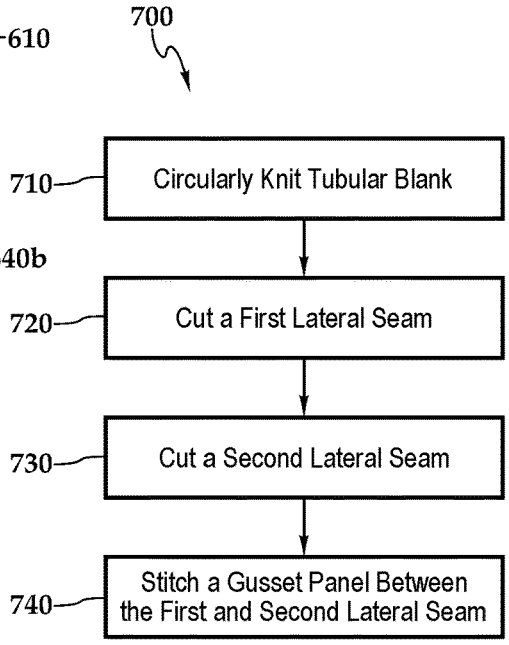
FIG. 7 is a flow diagram of an example process for making an undergarment.

FIG. 7 is a flow diagram of an example process 700 for making an undergarment. In some implementations, the example process 700 can be a process for making the undergarment 100 of FIGS. 1-5.

At 710 a tubular blank is circularly knit to form a body of an undergarment. The body has a first end and a second end opposite the first. For example, the example garment body 110 can be circularly knit, and has a waist end 170*a* and a leg end 170*b*.

The body includes an anterior knit region having a first knitting pattern, an outer edge, and an inner edge, and is configured to extend or stretch across a portion of a wearer's pelvic area. For example, the example anterior knit region 120 can have a knit pattern that is different from that of the example lateral panels 140*a*, 140*b*, and has the outer edges 122*a* and 122*b*.

The body also includes a posterior knit region having the first knitting pattern, an outer edge, an inner edge, and is configured to extend or stretch about a portion of the wearer's gluteal area. For example, the example posterior knit region 130 can have a knit pattern that is different from that of the example lateral panels 140*a*, 140*b*, and has the outer edges 132*a* and 132*b*.

The body also includes a first lateral knit region having a second knitting pattern different from the first knitting pattern, extending between the outer edge of the anterior knit region and the outer edge of the posterior knit region, and configured to extend or stretch about a portion of the wearer's left hip and a lateral portion of the wearer's left upper thigh. For example, the lateral panel 140*a* extends between the outer edge 122*a* and the outer edge 132*a*.

The body also includes a second lateral knit region having the second knitting pattern, extending between the outer edge of the anterior knit region and the outer edge of the posterior knit region, and configured to extend or stretch about a portion of the wearer's right hip and a lateral portion of the wearer's right upper thigh. For example, the lateral panel 140*b* extends between the outer edge 122*b* and the outer edge 132*b*.

At 720, a first lateral seam is cut through a centrally located portion of the second end of the anterior knit region. For example, the example anterior knit region 120 is cut, starting at the leg end 170*b*, from a midpoint between the outer edges 122*a* and 122*b*, to the run guard 126. The two sides of this cut form the inner edges 124*a* and 124*b*.

At 730, a second lateral seam is cut through a centrally located portion of second end of the posterior region. For example, the example posterior knit region 130 is cut, starting at the leg end 170*b*, from a midpoint between the outer edges 132*a* and 132*b*, to the run guard 136. The two sides of this cut form the inner edges 134*a* and 134*b*.

At 740, a gusset panel having the second knitting pattern is stitched between an entirety of the first seam and the second seam, and is configured to extend or stretch about an inner portion of the wearer's left upper thigh, a portion of the wearer's groin, and an inner portion of the wearer's right upper thigh. For example, the example gusset panel 160 is stitched along the inner seams 124*a*, 124*b*, 134*a*, and 134*b*, to extend across the cut that was made to separate the anterior knit region 120 from the posterior knit region 130.

In some implementations, the example process 700 can also include knitting the second knitting pattern in a knit mesh pattern. In some implementations, the regions having the second knitting pattern can have a weight of less than 8.5 ounces per square yard. For example, the lateral knit regions 140*a*, 140*b*, and the gusset panel 160 can be knit with the example stitch pattern 601 shown in FIG. 6.

In some implementations, the regions having the second knitting pattern can include an elastic 2×2 float knit structure that includes a ground yarn covered with an elastomer, and is float plated with a nylon thread. In some implementations, the second knitting pattern can include a collection of groups of three first openings arranged in a line, visible when stretched, wherein the groups are spaced apart by a plurality of second openings that are smaller than the first openings, and the regions having the second knitting pattern include about three hundred of the groups per square inch when the knit mesh is relaxed. For example, the example stitch pattern 601 includes the group 620 of the three openings 630*a*-630*c* arranged in a line, which is spaced apart from other groups by smaller openings such as the openings 640*a*-640*c*.

In some implementations, the example process 700 can also include circularly knitting a tubular blank to form a tubular waistband of the undergarment, and stitching the tubular waistband to the anterior knit region, the first lateral knit region, the posterior knit region, and the second lateral knit region at the first end of the pant body. For example, the example waistband 150 can be circularly knit and then stitched to the example pant body 110 at the waist end 170*a*.

In some implementations, the example process 700 can also include knitting a first gusset leg band knit region having the first knitting pattern along a portion of a first longitudinal end of the gusset panel, knitting a second gusset leg band knit region having the first knitting pattern along a portion of a second longitudinal end of the gusset panel opposite the first longitudinal end of the gusset panel, stitching the first gusset leg band knit region to the anterior knit region and to the posterior knit region proximal the second end, and stitching the second gusset leg band knit region to the anterior knit region and to the posterior knit region proximal the second end. For example, the example gusset panel 160 includes the leg band regions 164*a* and 164*b* at the lengthwise opposite ends of the gusset panel 160. The leg band regions are knit with a second knitting pattern that is different from the first knitting pattern, and the leg band regions 164*a* and 164*b* are stitched to the anterior knit region 120 and to the posterior knit region 130 near the leg end 170*b*.

In some implementations, the example process 700 can include circularly knitting a run guard knit region having a positive float pattern with an alternating 1×1 knit structure into a medial region of the anterior knit region and a medial region of the posterior knit region, and stitching the a lengthwise centrally located edge portion of the gusset panel to the run guard knit region, wherein at least one of the first lateral seam and the second lateral seam extend from the centrally located portion of the second end to the run guard knit region. For example, the run guard knit region 126 can be circularly knit into the anterior knit region 120, and the run guard knit region 136 can be circularly knit into the posterior knit region 130. The inner seams 124*a* and 124*b* are cut from the middle of the leg end 170*b* to the run guard 126, and the inner seams 134*a* and 134*b* are cut from the middle of the leg end 170*b* to the run guard 136.

Although a few implementations have been described in detail above, other modifications are possible. For example, the descriptions above generally discuss undergarments, but the concepts described herein can also be applied to other (e.g., visible) garments as well. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A garment comprising:

a pant body having a first end and a second end opposite the first end, the pant body comprising:

an anterior knit region having a first knitting pattern, a first outer edge and a second outer edge, and a first inner edge and second inner edge, and configured to stretch across a portion of a wearer's pelvic area;

a posterior knit region having the first knitting pattern, a third outer edge and a fourth outer edge, and a third inner edge and a fourth inner edge, and configured to stretch about a portion of the wearer's gluteal area;

a first lateral knit region having a second knitting pattern different from the first knitting pattern, extending between the first outer edge of the anterior knit region and the third outer edge of the posterior knit region, and configured to stretch about a portion of the wearer's left hip and a lateral portion of the wearer's left upper thigh; and a second lateral knit region having the second knitting pattern, extending between the outer edge of the anterior knit region and the outer edge of the posterior knit region, and configured to stretch about a portion of the wearer's right hip and a lateral portion of the wearer's right upper thigh;

wherein regions having the second knitting pattern are elastic 2×2 float knit structures comprising a ground yarn covered with an elastomer that is float plated with a nylon thread.

2. The garment of claim 1, wherein the anterior knit region, the first lateral knit region, the posterior knit region, and the second lateral knit region are a circularly knit, tubular body.

3. The garment of claim 2, further comprising a gusset panel having the second knitting pattern, extending between an entirety of the inner edge of the anterior knit region and the inner edge of the posterior knit region, and configured to stretch about an inner portion of the wearer's left upper thigh, a portion of the wearer's groin, and an inner portion of the wearer's right upper thigh, wherein the gusset panel is stitched to the anterior knit region and to the posterior knit region.

4. The garment of claim 1, wherein the second knitting pattern is a knit mesh pattern.

5. The garment of claim 1, wherein regions having the second knitting pattern have a weight of less than 8.5 ounces per square yard.

6. The garment of claim 1, wherein the second knitting pattern comprises a plurality of groups of three first openings arranged in a line, wherein the groups are spaced apart by a plurality of second openings that are smaller than the first openings, and regions having the second knitting pattern comprise about three-hundred of the groups per square inch when the knit mesh is relaxed.

7. The garment of claim 1, further comprising a tubular waistband attached to the anterior knit region, the first lateral knit region, the posterior knit region, and the second lateral knit region at the first end of the pant body.

8. The garment of claim 1, further comprising at least one of:

a first tubular leg band attached to the anterior knit region, the first lateral knit region, and the posterior knit region; and a second tubular leg band attached to the anterior knit region, the second lateral knit region, and the posterior knit region.

9. The garment of claim 1, further comprising a run guard knit region having a positive float pattern with an alternating 1×1 knit structure.

10. A method of making a garment, the method comprising:

circularly knitting a tubular blank to form a body of a garment, the body having a first end and a second end opposite the first end and comprising:

an anterior knit region having a first knitting pattern, having an outer edge and an inner edge, and configured to stretch across a portion of a wearer's pelvic area;

a posterior knit region having the first knitting pattern, having an outer edge and an inner edge, and configured to stretch about a portion of the wearer's gluteal area;

a first lateral knit region having a second knitting pattern different from the first knitting pattern, extending between the outer edge of the anterior knit region and the outer edge of the posterior knit region, and configured to stretch about a portion of the wearer's left hip and a lateral portion of the wearer's left upper thigh; and a second lateral knit region having the second knitting pattern, extending between the outer edge of the anterior knit region and the outer edge of the posterior knit region, and configured to stretch about a portion of the wearer's right hip and a lateral portion of the wearer's right upper thigh, wherein regions having the second knitting pattern are elastic 2×2 float knit structures comprising a ground yarn covered with an elastomer float plated with a nylon thread.

11. The method of claim 10, further comprising knitting the second knitting pattern in a knit mesh pattern.

12. The method of claim 10, wherein regions having the second knitting pattern have a weight of less than 8.5 ounces per square yard.

13. The method of claim 10, wherein the second knitting pattern comprises a plurality of groups of three first openings arranged in a line, wherein the groups are spaced apart by a plurality of second openings that are smaller than the first openings, and the regions having the second knitting pattern comprise about three-hundred of the groups per square inch when the knit mesh is relaxed.

14. The method of claim 10, further comprising:

circularly knitting a tubular blank to form a tubular waistband of the garment; and stitching the tubular waistband to the anterior knit region, the first lateral knit region, the posterior knit region, and the second lateral knit region at the first end of the pant body.

15. The method of claim 10, further comprising:

knitting a first leg band knit region having the first knitting pattern along a portion of the first lateral panel proximal the second end; and knitting a second leg band knit region having the first knitting pattern along a portion of the second lateral panel proximal the second end.

16. The method of claim 10, further comprising:

cutting a first lateral seam through a centrally located portion of the second end of the anterior knit region;

cutting a second lateral seam through a centrally located portion of second end of the posterior region;

stitching a gusset panel, having the second knitting pattern, between an entirety of the first seam and the second seam, and configured to stretch about an inner portion of the wearer's left upper thigh, a portion of the wearer's groin, and an inner portion of the wearer's right upper thigh;

knitting a first gusset leg band knit region having the first knitting pattern along a portion of a first longitudinal end of the gusset panel;

knitting a second gusset leg band knit region having the first knitting pattern along a portion of a second longitudinal end of the gusset panel opposite the first longitudinal end of the gusset panel;

stitching the first gusset leg band knit region to the anterior knit region and to the posterior knit region proximal the second end; and stitching the second gusset leg band knit region to the anterior knit region and to the posterior knit region proximal the second end.

17. The method of claim 16, further comprising:

circularly knitting a run guard knit region having a positive float pattern with an alternating 1×1 knit structure into a medial region of the anterior knit region and a medial region of the posterior knit region; and stitching the a lengthwise centrally located edge portion of the gusset panel to the run guard knit region;

wherein at least one of the first lateral seam and the second lateral seam extend from the centrally located portion of the second end to the run guard knit region.

* * * * *